US005131518A

United States Patent [19]

Shimizu

[11] Patent Number: 5,131,518

[45] Date of Patent: Jul. 21, 1992

[54] COIN TESTING APPARATUS

[75] Inventor: Kazuo Shimizu, Isesaki, Japan

[73] Assignee: Sanden Corporation, Japan

[21] Appl. No.: 511,326

[22] Filed: Apr. 19, 1990

[30] Foreign Application Priority Data

Apr. 21, 1989 [JP] Japan ..... 1-46185[U]

[51] Int. Cl.[5] ..... G07D 5/08

[52] U.S. Cl. ..... 194/318; 324/225

[58] Field of Search ..... 194/317, 318, 319; 324/225, 236

[56] References Cited

U.S. PATENT DOCUMENTS

| | | | |
|---|---|---|---|
| 3,916,922 | 11/1975 | Prumm . | |
| 3,918,564 | 11/1975 | Heiman et al. . | |
| 4,108,296 | 8/1978 | Hayashi et al. . | |
| 4,234,072 | 11/1980 | Prumm . | |
| 4,286,703 | 9/1981 | Schuller et al. . | |
| 4,334,604 | 6/1982 | Davies . | |
| 4,349,095 | 9/1982 | Lewis . | |
| 4,538,719 | 9/1985 | Gray et al. | 324/236 X |
| 4,601,380 | 7/1986 | Dean et al. . | |
| 4,625,851 | 12/1986 | Johnson et al. . | |
| 4,625,852 | 12/1986 | Hoormann . | |
| 4,838,405 | 6/1989 | Kimoto | 194/318 |

FOREIGN PATENT DOCUMENTS

| | | | |
|---|---|---|---|
| 0122732 | 3/1984 | European Pat. Off. . | |
| 52-43497 | 4/1977 | Japan . | |
| 55-62350 | 5/1980 | Japan . | |
| 61-237190 | 10/1986 | Japan . | |
| 2029995 | 6/1979 | United Kingdom . | |
| 2068621 | 2/1980 | United Kingdom . | |
| 85/04037 | 9/1985 | World Int. Prop. O. | 194/317 |

*Primary Examiner*—F. J. Bartuska

*Attorney, Agent, or Firm*—Banner, Birch, McKie & Beckett

[57] ABSTRACT

A coin testing apparatus has a sensor outputting a detected signal corresponding to a deposited coin, a determinator for determining the value of the detecting signal, a discriminator for discriminating the authenticity and type of the coin by comparing the determined value with a coin acceptance range defined by maximum and minimum reference values, an initializor for initializing the coin acceptance range and memory for renewing the coin acceptance range by adding a predetermined value to or subtracting the predetermined value from the maximum and minimum reference values, respectively, when the practical determination range varies. Since the coin acceptance range is automatically corrected by the operation even if there is a variation in the range of the detected signal due to a drift of an electronic circuit or by variation in temperature, a correct and precise determination can be achieved.

9 Claims, 7 Drawing Sheets

COIN TESTING APPARATUS

BACKGROUND OF THE INVENTION

1. Field of the Invention

The present invention relates to a coin testing apparatus which is used in vending machines and the like, and more particularly to a coin testing apparatus which tests the authenticity of deposited coins and determines the denomination of deposited coins.

2. Description of the Prior Art

A conventional coin testing apparatus tests the authenticity and denomination of a coin by determining the size, thickness, weight or material of a coin and comparing the determined data with a preset reference value or reference range.

One such conventional coin testing apparatus determines the authenticity and denomination of a coin by discriminating between the material or size of the coin. A pair of coils are disposed on both sides of a coin path so as to confront each other. An alternating current is applied to one of the coils and an induced voltage is generated in the other coil. When a coin passes through the sensing area between the coils, the induced voltage varies according to the material or size of the coin. The value of the varying induced voltage at a maximum variation point is detected by an electronic circuit. The material or size of the coin, (i.e.—the authenticity and type of the coin) is determined by comparing the detected voltage value with a predetermined coin acceptance range for the type of coins.

In the conventional apparatus, however, when the detected level of the induced voltage varies due to a drift in the electronic circuit caused by deterioration of the coils or the elements constituting the electronic circuit or due to a variation in temperature, the determination of the coins may be in error. In particular, when coins having similar materials or sizes are to be discriminated from each other, the difference between the values of the varying induced voltages detected by the coil is very small. Therefore, if there is a relatively large variation in the detected level of the induced voltage due to the drift in the electronic circuit or due to variation in temperature, a small difference in the detected values of the different types of coins cannot be discriminated. In such a case, the discrimination of the type or the authenticity of coins may be in error.

With respect to the above problem, if a self-tuning coin recognition system such as one disclosed in WO 85/04037 (PCT/US85/00369; JP-A-SHO 61-501349) is used in the apparatus, or if the electronic circuit is constructed using high-durability elements having stable high temperature and high humidity characteristics, the influence due to the above-mentioned variation of the detected voltage levels could be overcome. A self-tuning system requires a complicated statistical operation and whether the device is operating properly cannot be easily confirmed. High-durability elements are expensive and the cost of the apparatus is too high and thus is not practical.

SUMMARY OF THE INVENTION

Accordingly, it is an object of the present invention to provide an inexpensive coin testing apparatus which can precisely determine the authenticity and type of a coin by a simple operation even if a variation in the detected level of an induced voltage in a coil occurs due to drift in the electronic circuit or a variation in temperature.

To accomplish this object, a coin testing apparatus according to the present invention is herein provided. The apparatus includes a sensor provided on a coin path for outputting a detecting signal varying according to the characteristic of a coin deposited into the coin path; means for determining the value of the detecting signal at a maximum variation point of the detecting signal when the coin passes through the sensing area of the sensor; means for discriminating the authenticity and type of the coin by comparing the value at the maximum variation point with a coin acceptance range defined by a maximum reference value and a minimum reference value; means for determining a maximum value and a minimum value among the values at the maximum variation points for a plurality of a type of coins which are deposited into the coin path for initializing the coin acceptance range; means for initializing the coin acceptance range by setting the maximum reference value equal to the sum of a predetermined value and the maximum value and setting the minimum reference value equal to the difference of a predetermined value and the minimum value; and means for renewing the coin acceptance range, when coins deposited into the coin path are discriminated by the discriminating means after the initialization, by resetting the maximum and minimum reference values by subtracting a predetermined value from the maximum reference value and the minimum reference value, respectively, when the value of the detected signal at the maximum variation point of any of the deposited coins is equal to the minimum reference value, and by adding a predetermined value to the maximum reference value and the minimum reference value, respectively, when the value of the detected signal at the maximum variation point of any of the deposited coins is equal to the maximum reference value.

In the coin testing apparatus, when the coin acceptance range is initialized, a plurality of coins are deposited into the coin path and detected by the sensor which detects the values at the maximum variation points of the detected signals corresponding to a respective coins. A maximum value and a minimum value of the detected values are then determined. The maximum reference value is initialized by adding a predetermined value to the maximum value. The minimum reference value is initialized by subtracting a predetermined value from the minimum value.

When coins are tested and discriminated by the discriminating means after the initialization, the authenticity and type of the coins are determined by comparing the values at the maximum variation points of the detecting signals detected and output by the sensor with the coin acceptance range defined by the initialized maximum and minimum reference values.

When there is a variation in the level of the detected signal caused by a drift in an electronic circuit or by a variation in temperature, the acceptance range is automatically corrected as follows. When the value of the detected signal at the maximum variation point becomes equal to the minimum reference value, a predetermined value is subtracted from the maximum reference value and the minimum reference value, respectively. These values are then set as renewed maximum and minimum reference values. The renewed coin acceptance range defined by the renewed maximum and minimum reference values is stored in place of the previous range.

When the value of the detected signal at the maximum variation point becomes equal to the maximum reference value, a predetermined value is added to the maximum reference value and the minimum reference value, respectively. These values are then set as renewed maximum and minimum reference values. The renewed coin acceptance range defined by the renewed maximum and minimum reference values is stored in place of the previous range. Thus, the coin acceptance range is automatically corrected according to the variation of the detected signal level.

Since the coin acceptance range is adequately and automatically corrected even though there is a variation in the detected signal level due to a drift in an electronic circuit caused by deterioration of the components or by variation in ambient temperature, the influence of the variation in the detected signal level to the operation of the coin tester is removed and precise determination can be achieved. Moreover, the initialization and correction of the coin acceptance range can be conducted by simple operations. Furthermore, since relatively cheap components similar to those used in the conventional apparatus can be used for the components constituting the electronic circuit, the coin testing apparatus according to the present invention can be provided at a low cost.

BRIEF DESCRIPTION OF THE DRAWINGS

Some preferred exemplary embodiments of the invention will now be described with reference to the accompanying drawings which are given by way of example only, and thus are not intended to limit the present

DETAILED DESCRIPTION OF PREFERRED EMBODIMENTS OF THE INVENTION

Figure 1:
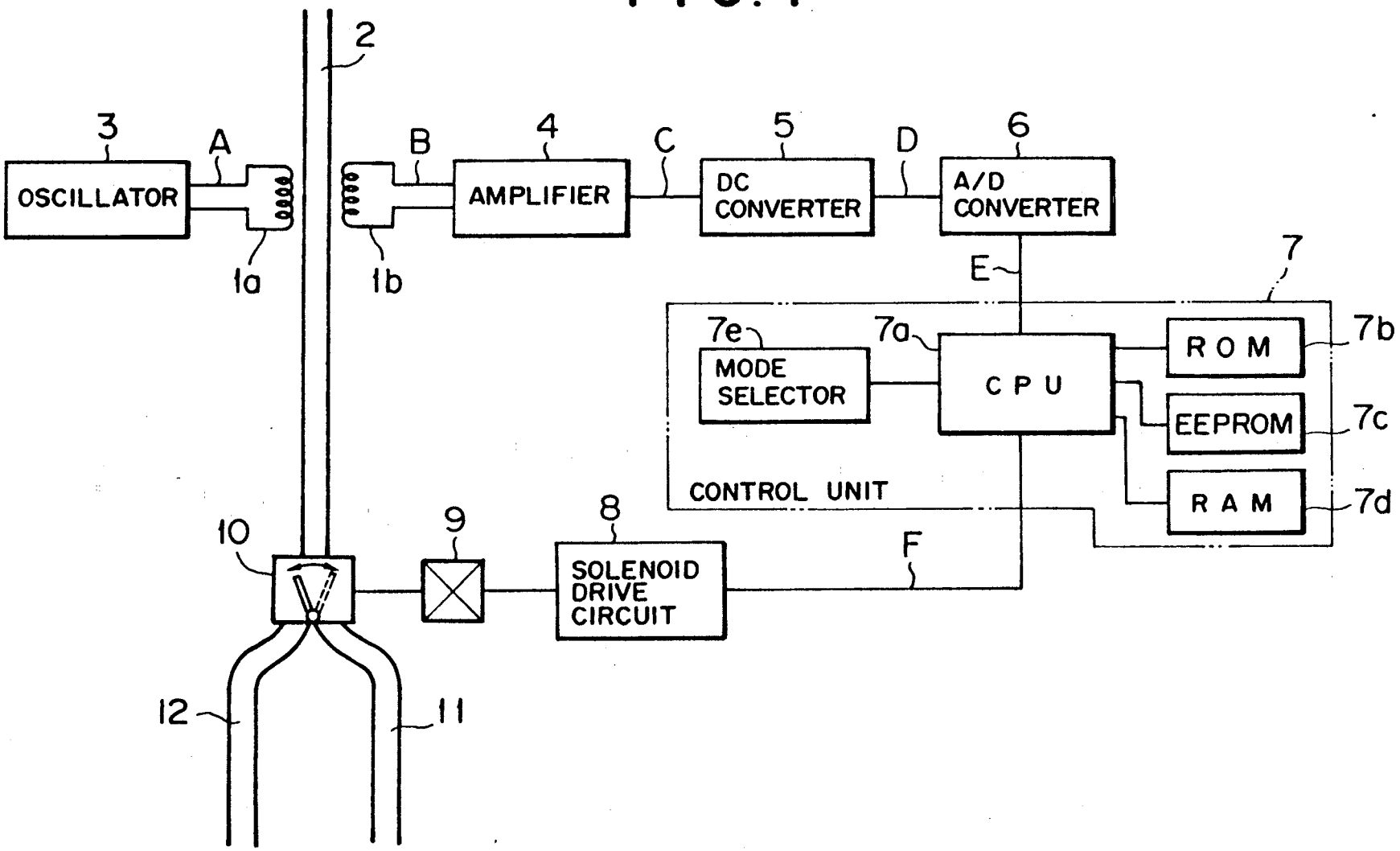
FIG. 1 is a schematic block diagram of a coin testing apparatus according to a first embodiment of the present invention.

Referring to the drawings, FIGS. 1-6 illustrate a coin testing apparatus and its operation according to a first embodiment of the present invention. In FIG. 1, a pair of coils 1*a* and 1*b* are disposed so as to confront each other on both sides of a coin path 2 and output a detected signal varying according to the characteristic of a coin deposited into the coin path. Coil 1*a* is connected to the output side of oscillator 3 generating an alternating voltage A at a constant amplitude and a predetermined frequency. Coil 1*b* is connected to the input side of amplifier 4. Amplifier 4 is connected to the input side of DC converter 5, which in turn is connected to the input side of A/D converter (analog/digital converter) 6. A/D converter 6 is connected to CPU (central processor unit) 7*a* in control unit 7. An induced voltage B induced in coil 1*b* is amplified by amplifier 4 producing an amplified induced voltage C which is converted to a D.C. voltage D by DC converter 5. D.C. voltage D is converted to a digital data (digital signal) E by A/D converter 6, and the digital data E is input into CPU 7*a* as a detected signal sent from coil 1*b*.

Control unit 7 comprises CPU 7*a*, first memory (ROM: read only memory) 7*b*, second memory (EEPROM: electric erasable program ROM) 7*c*, RAM (random access memory) 7*d* and mode selector 7*e*. Programs shown in FIGS. 3 and 4 which will be described later are stored in ROM 7*b*, where they are read by CPU 7*a*. Maximum and minimum reference values for initializing a coin acceptance range are stored in EEPROM 7*c*, and CPU 7*a* reads the stored values for operation according to the programs. Data in RAM 7*d* is accessed by CPU 7*a* during program operation.

Mode selector 7*e* switches the operation mode of control unit 7 between an adjusting mode and a testing mode. The adjusting mode initializes the coin acceptance range and the testing mode tests the authenticity of deposited coins and determines the type of coins deposited.

Signal F output from CPU 7*a* is sent to a solenoid drive circuit 8 for controlling solenoid 9. Solenoid 9 is connected to distributing gate 10 provided at the end portion of coin path 2 and actuates distributing gate 10 between a position communicating coin path 2 with acceptance coin path 11 and a position communicating coin path 2 with discharge path 12. In this embodiment, when a deposited coin is an acceptable coin, gate signal F is output as a high-level signal, and solenoid drive circuit 8 supplies a driving voltage for actuating distributing gate 10 to the position communicating coin path 2 with acceptance coin path 11 for a predetermined period of time.

The operation of this coin testing apparatus in accordance with a type of coins will be explained with reference to a waveform diagram shown in FIG. 2 and flowcharts shown in FIGS. 3 and 4.

Figure 2:
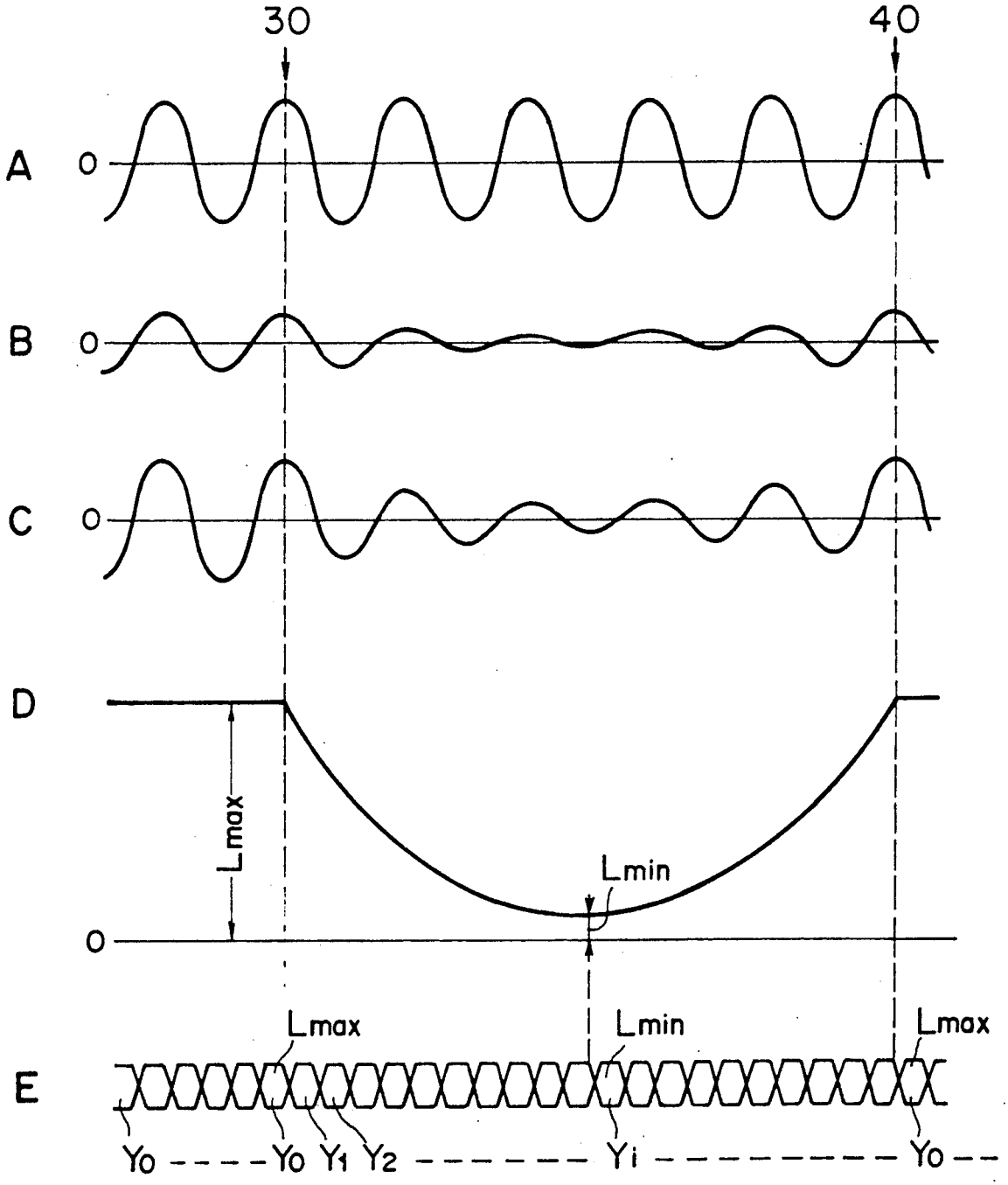
FIG. 2 is a waveform diagram of signals of the apparatus shown in FIG. 1.

Oscillator 3 applies an alternating voltage A with a constant amplitude and a predetermined frequency to coil 1*a* as shown in FIG. 2. An induced voltage B is generated in coil 1*b* by the alternating voltage A. When a coin enters into the sensing area between coils 1*a* and 1*b*, the amplitude of the induced voltage B gradually decreases and then gradually increases as the coin leaves the sensing area. Coin entering point 30 shown in FIG. 2 shows the point where the coin begins to enter the sensing area and coin leaving point 40 shows the point where the coin has completely left the sensing area. The induced voltage B of coil 1*b* is amplified by amplifier 4 and outputs signal C. Signal C is converted to D.C. voltage signal D by DC converter 5. D.C. voltage signal D is converted to digital signal E by A/D converter 6 and digital signal E is input to CPU 7*a*. In D.C. voltage signal D, Lmax shows the maximum voltage, (i.e.—the original voltage) before the coin was deposited or entered the sensing area. Lmin shows the value of the detected signal detected by coil 1*b* at a maximum variation point of the detected signal when the coin passes through the sensing area between coils 1a and 1b. Digital signal E has a digital value corresponding to the D.C. voltage signal D. Digital signal E illustrated by crossed lines in FIG. 2 merely shows the timing of the conversion from D.C. voltage signal D to the digital signal. The intersection points of the lines represent conversion points and digital signal E between a intersection point and the next intersection point has a digital value $Y_0$, $Y_1$ —, or Yi. Namely, digital signal E before coin entering point 30 and after coin leaving point 40 has a digital value $Y_0$ corresponding to the value of Lmax. Digital signal E between coin entering point 30 and coin leaving point 40 has digital values $Y_1$, $Y_2$, —. Digital signal E corresponding to the maximum variation point has a digital value Yi corresponding to the value of Lmin.

In the adjusting mode, mode selector 7e is switched to the adjusting mode. A plurality of a type of coins to be tested (for example, fifty quarters) are deposited into coin path 2 and passed through the sensing area between coils 1a and 1b.

Figure 3:
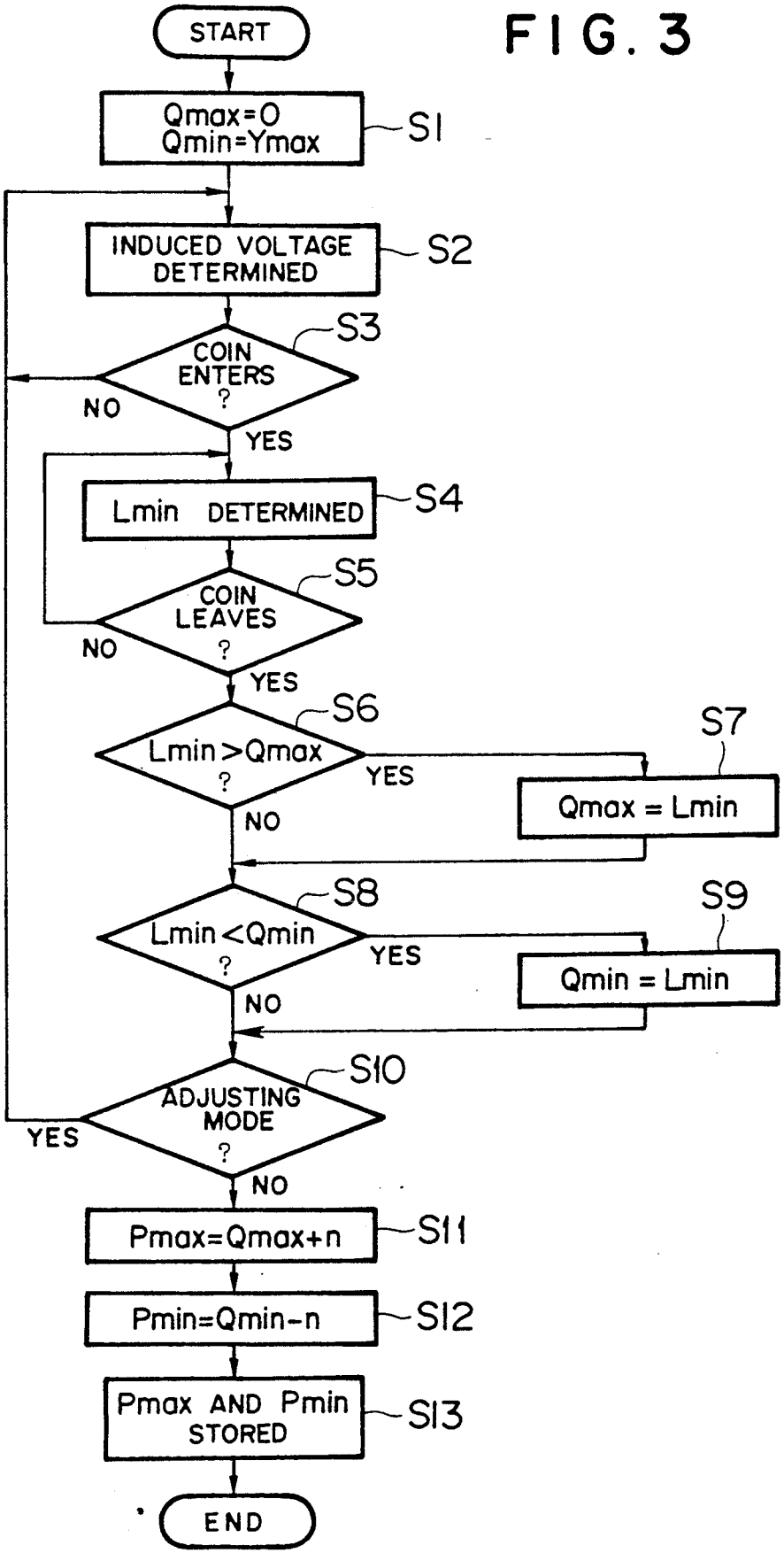
FIG. 3 is a flowchart of an adjusting mode of control unit assembly of the apparatus shown in FIG. 1.

FIG. 3 shows a flowchart for the adjusting mode. When mode selector 7e is switched to the adjusting mode, CPU 7a of control unit 7 sets the initial value of maximum value Qmax to zero and the initial value of minimum value Qmin to a maximum value Ymax possible to be expressed by the digital data E at step S1. Qmax and Qmin represent the maximum and minimum values respectively of the values Lmin at the maximum variation points for a plurality of types of deposited coins. In setting the initial values of Qmax and Qmin as described above, the Lmin subsequently determined will surely be larger than the initial value of Qmax and smaller than the initial value of Qmin.

At step S2, the amplitude of induced voltage B is determined by digital data E output from A/D converter 6. At step S3, it is determined whether a coin has entered the sensing area between coils 1a and 1b, according to the variation of digital data E. If it is determined that a coin has not entered the sensing area, flow returns to step S2. If it is determined that a coin has entered the sensing area, digital data E (Yi in FIG. 2) corresponding to Lmin of the coin is determined (step S4). At step S5, it is determined whether the coin has completely left the sensing area. If the coin has not yet completely left the sensing area, the operation of step S4 is continued. If the coin has completely left the sensing area, flow proceeds to step S6.

At step S6, it is determined whether the determined value of Lmin is greater than the present maximum value Qmax. If Lmin is greater than Qmax, this Lmin is stored as a renewed Qmax (step S7). After step S7 or if Lmin is determined not to be greater than Qmax at step S6, it is determined whether the Lmin is smaller than the present minimum value Qmin (step S8). If Lmin is smaller than Qmin, this Lmin is stored as a renewed Qmin (step S9). After step S9 or if Lmin is determined not to be smaller than Qmin at step S8, it is determined whether the present mode is adjusting mode (step S10). If the present mode is adjusting mode, flow returns to step S2 and steps S2–S10 are repeated. If the present mode is switched to testing mode, a predetermined value (an allowable error value) n is added to the maximum value Qmax and this value is set as a maximum reference value Pmax of the coin acceptance range (step S11). Further, the predetermined value n is subtracted from the minimum value Qmin and this value is set as a minimum reference value Pmin of the coin acceptance range (step S12). These maximum and minimum reference values Pmax and Pmin are stored in EEPROM 7c (step S13). Thus, the coin acceptance range for the type of coins is initialized.

Figure 4:
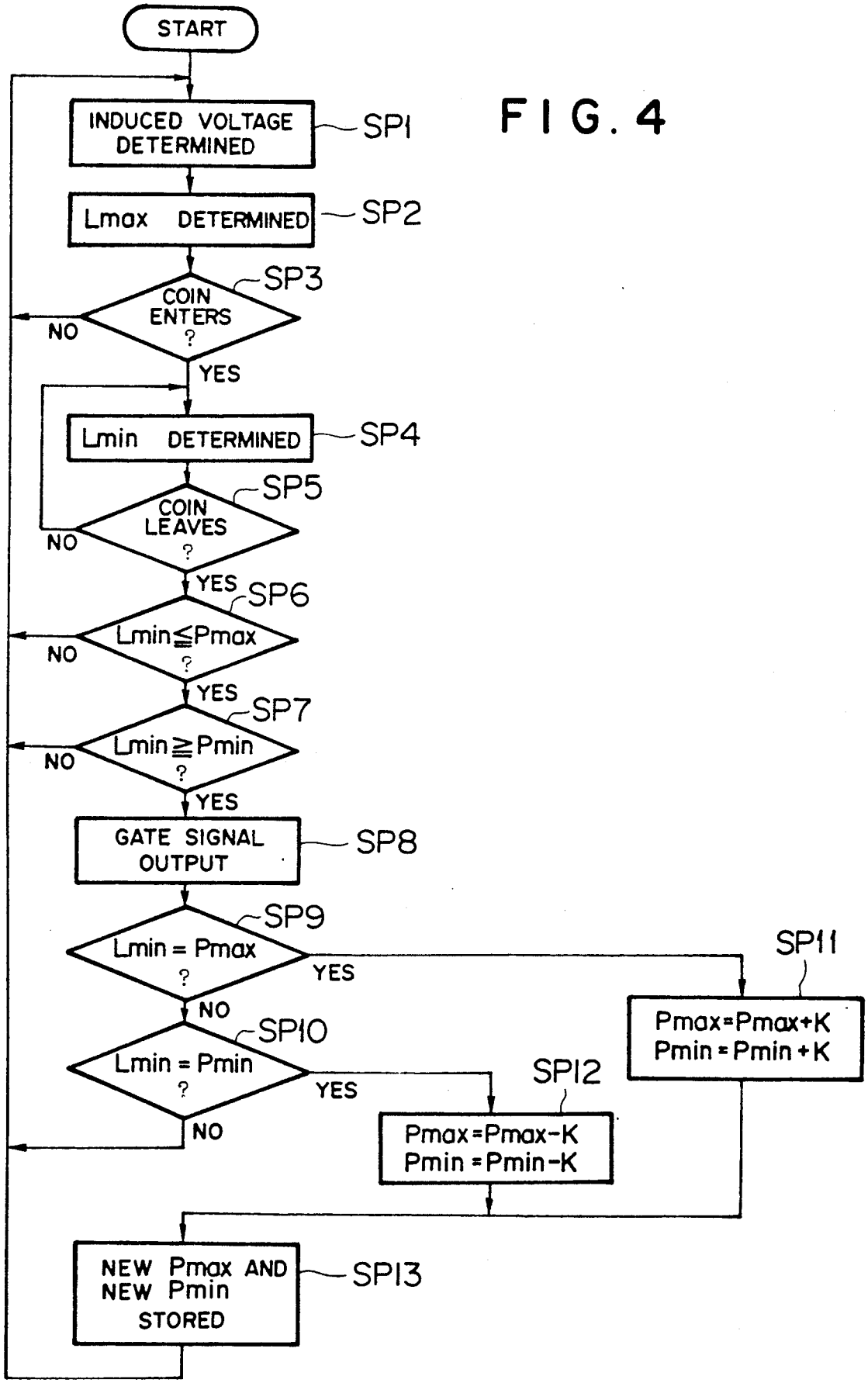
FIG. 4 is a flowchart of a testing mode of the control unit assembly of the apparatus shown in FIG. 1.

FIG. 4 shows a flowchart for the testing mode. The amplitude of induced voltage B is determined according to digital data E (step SP1), and the value $Y_0$ of digital data E is stored as a value corresponding to the maximum value Lmax before a coin has entered the sensing area between coils 1a and 1b (step SP2). At step SP3, it is determined whether a coin has entered the sensing area according to the variation of digital data E. If it is determined that a coin has not entered the sensing area, flow returns to step SP1. If it is determined that a coin has entered the sensing area, digital data E (Yi in FIG. 2) corresponding to Lmin of the coin is determined (step SP4). At step SP5, it is determined whether the coin has completely left the sensing area. If the coin has not yet left the sensing area, the operation of step SP4 is continued. If the coin has completely left the sensing area, flow proceeds to step SP6.

At step SP6, it is determined whether the determined value of Lmin is less than or equal to the maximum reference value Pmax of the coin acceptance range stored in EEPROM 7c. If Lmin is greater than Pmax, this coin is determined to be an unacceptable coin, a slug or a coin of different denomination. If Lmin is less than or equal to Pmax, it is determined whether Lmin is greater than or equal to the minimum reference value Pmin of the coin acceptance range stored in EEPROM 7c (step SP7). If Lmin is less than Pmin, the coin is determined to be an unacceptable coin, a slug or a coin of different denomination. If Lmin is less than or equal to Pmax at step SP6 and greater than or equal to Pmin at step SP7, namely if Lmin is determined to be in the coin acceptance range, gate actuating signal F (a high-level signal in this embodiment) is sent to solenoid drive circuit 8 for guiding the coin to acceptance coin path 11 (step SP8). If Lmin is out of the coin acceptance range (in a case where there are a plurality of coin acceptance ranges, if Lmin is out of any coin acceptance range), the gate actuating signal is not output and the unacceptable coin or slug is guided into discharge path 12.

At step SP9, it is determined whether Lmin is equal to the stored maximum reference value Pmax. If Lmin is equal to Pmax, flow proceeds to step SP11. If Lmin is not equal to Pmax, it is determined whether Lmin is equal to the stored minimum reference value Pmin (step SP10). If Lmin is not equal to Pmin, flow returns to step SP1.

If Lmin is determined to equal Pmax at step SP9, a new maximum reference value Pmax is calculated by the following equation (1) and a new minimum reference value Pmin is calculated by the following equation (2):

$$Pmax = Pmax + K \quad (1)$$

$$Pmin = Pmin + K \quad (2)$$

Where K is a predetermined constant value. The predetermined value K is added to the maximum reference value Pmax and the minimum reference value Pmin, respectively, and the calculated values are set as renewed maximum and minimum reference values Pmax and Pmin.

If Lmin is determined to be equal to Pmin at step SP10, a new maximum reference value Pmax is calculated by the following equation (3) and a new minimum reference value Pmin is calculated by the following equation (4):

$$Pmax = Pmax - K \quad (3)$$

$$Pmin = Pmin - K \quad (4)$$

Where K is the same value as the one used in equations (1) and (2) in this embodiment. The predetermined value K is subtracted from the maximum reference value Pmax and the minimum reference value Pmin, respectively, and the calculated values are set as renewed maximum and minimum reference values Pmax and Pmin.

At step SP13, the renewed maximum and minimum reference values Pmax and Pmin calculated by the equations (1) and (2) or the equations (3) and (4) are stored in the memory of EEPROM 7c, and flow returns to step SP1 for the next deposited coin. The renewed coin acceptance range defined by these renewed maximum and minimum reference values Pmax and Pmin is applied to the next deposited coin.

Figure 5:
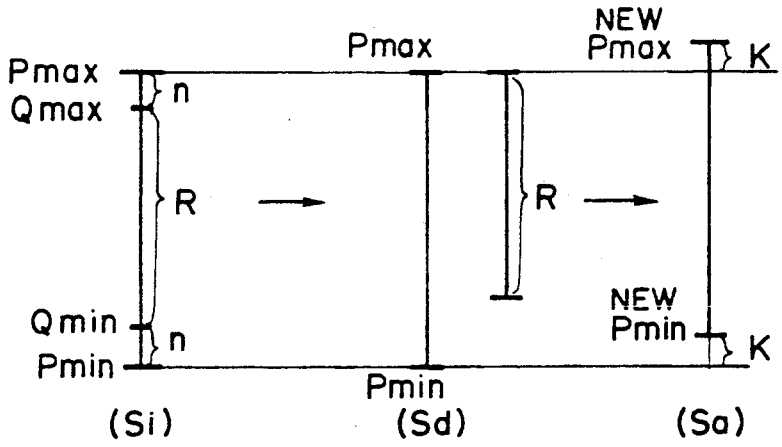
FIG. 5 is a chart of a coin acceptance range illustrating a manner of the correction of the coin acceptance range according to the present invention.
Figure 6:
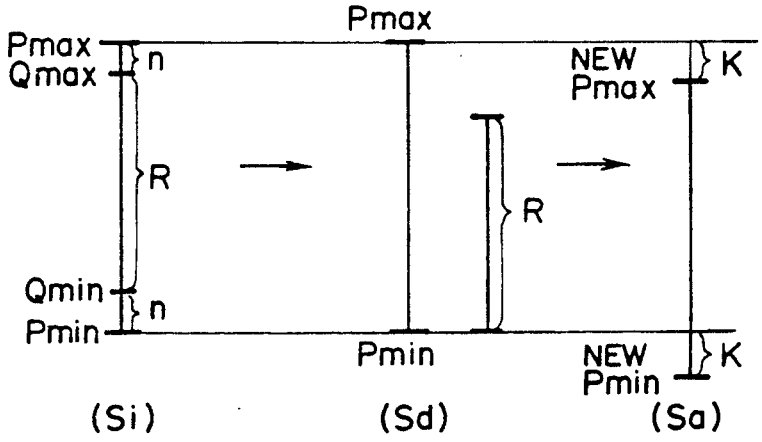
FIG. 6 is a concept diagram of a coin acceptance range illustrating another manner of the correction of the coin acceptance range according to the present invention.

FIGS. 5 and 6 show the concept of the above operation renewing a coin acceptance range.

In FIG. 5, Si shows the state of the initialized coin acceptance range defined by Pmax, set by adding the predetermined value n to the maximum value Qmax of the range R decided by the dermination of a plurality of a type of coin and Pmin set by subtracting n from the minimum value Qmin of the range R. When the range R for testing acceptable coins varies upwards as shown in state Sd, namely when the maximum value among the practically determined values Lmin reaches Pmax, the new Pmax and Pmin are calculated by adding K to the present Pmax and Pmin and the coin acceptance range is automatically corrected to the range defined by the new Pmax and Pmin as shown in state Sa.

In FIG. 6, if the range R varies downward as shown in state Sd, namely when the minimum value among the practically determined values Lmin reaches Pmin, the new Pmax and Pmin are calculated by subtracting K from the present Pmax and Pmin and the coin acceptance range is automatically corrected to the range defined by the new Pmax and Pmin as shown in state Sa.

As explained above, since the coin acceptance range is automatically corrected by the above mentioned operation when there is a variation in the digital data E due to drift of the electronic circuit or variation in temperature, the influence due to the variation can be removed and a precise determination of the deposited coins can be made. Moreover, since relatively cheap components similar to those used in a conventional apparatus can be used for the components constituting the electronic circuit of the apparatus according to the present invention, the cost of the apparatus according to the present invention is reduced.

Figure 8:
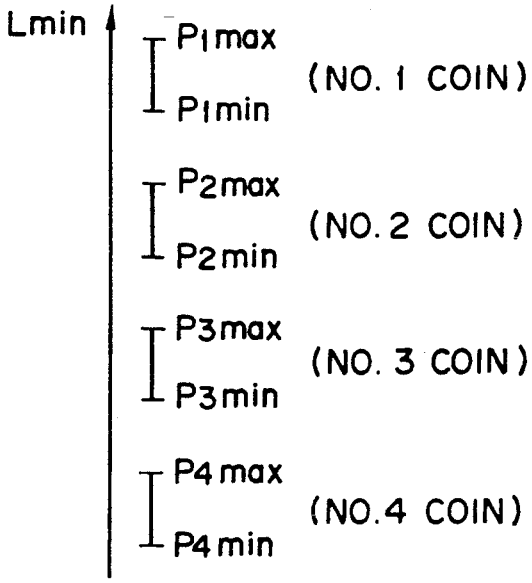
FIG. 8 is a concept diagram of coin acceptance ranges of the apparatus shown in FIG. 7.
Figure 7:
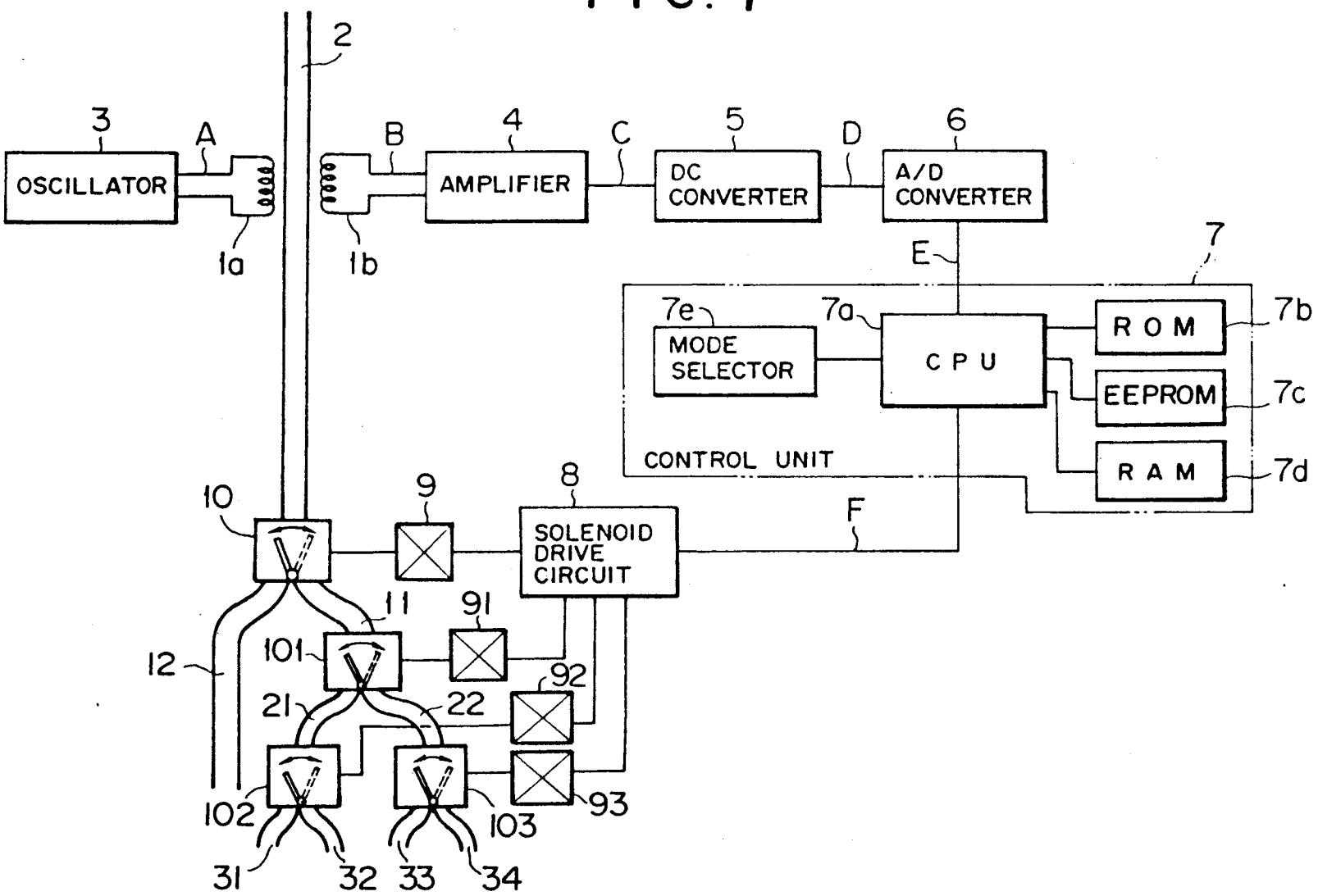
FIG. 7 is a schematic block diagram of a coin testing apparatus according to a second embodiment of the present invention.
Figure 9:
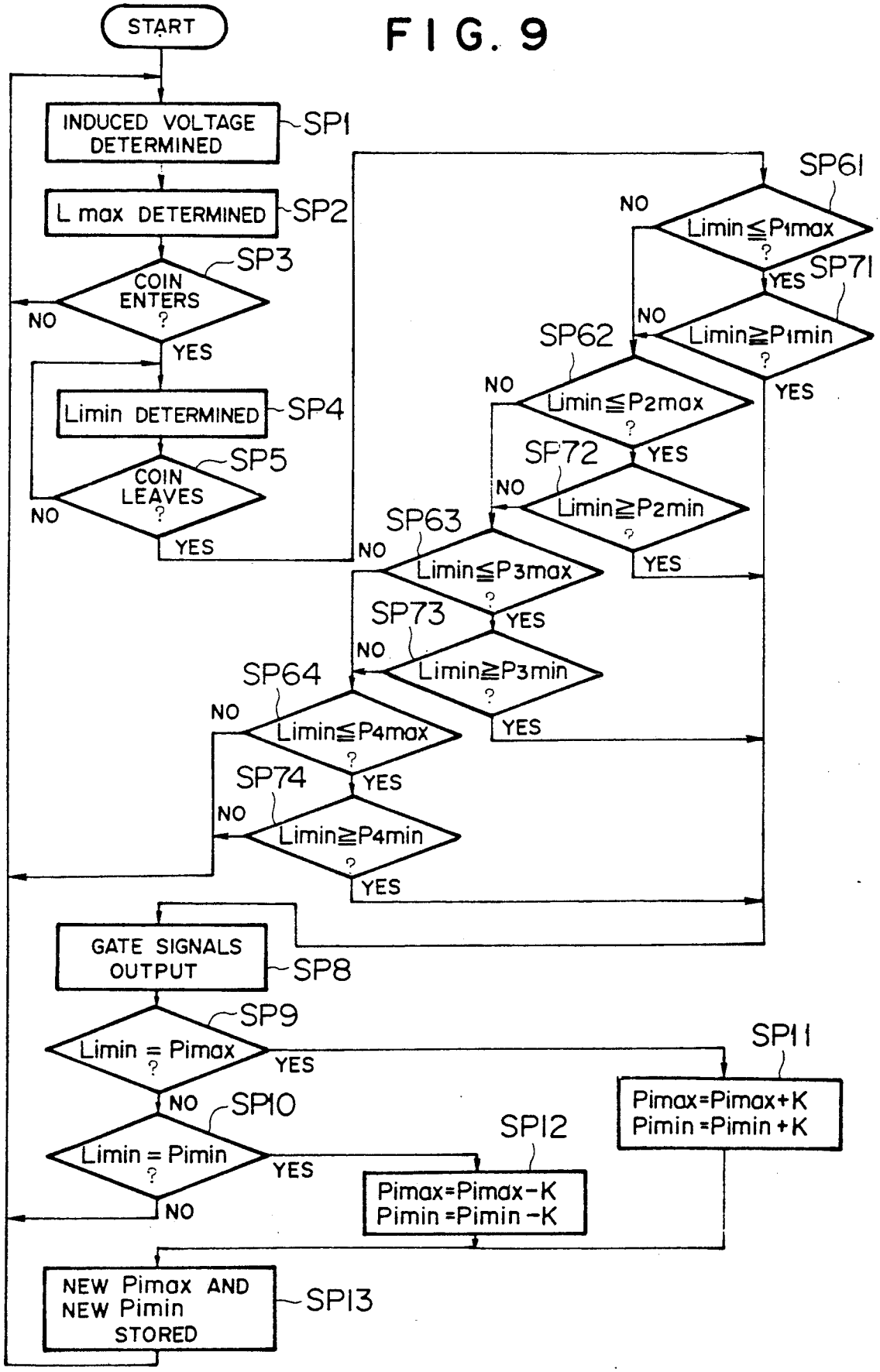
FIG. 9 is a flowchart of a testing mode of a control unit assembled in the apparatus shown in FIG. 7.

FIGS. 7-9 illustrate a second embodiment of the present invention.

In this embodiment, a plurality of types of coins (for example, NO. 1 coins: half-dollars, NO. 2 coins: quarters, NO. 3 coins: dimes and NO. 4 coins: nickels) are determined. In FIG. 7, acceptance coin path 11 is diverged to coin paths 21 and 22, coin path 21 is diverged to a coin path 31 (for example, for half-dollars) and a coin path 32 (for example, for quarters) and coin path 22 is diverged to a coin path 33 (for example, for dimes) and a coin path 34 (for example, for nickels). Solenoid 91 actuates distributing gate 101, solenoid 92 actuates distributing gate 102 and solenoid 93 actuates distributing gate 103. Solenoids 91, 92 and 93 are driven according to the signals from solenoid drive circuit 8.

Respective coin acceptance ranges for half-dollars defined by maximum reference value P1max and minimum reference value P1min, for quarters defined by maximum reference value P2max and minimum reference value P2min, for dimes defined by maximum reference value P3max and minimum reference value P3min and for nickels defined by maximum reference value P4max and minimum reference value P4min are initialized, for example, as shown in FIG. 8. The respective coin acceptance ranges preferably do not overlap each other.

FIG. 9 shows a flowchart for the testing mode. The steps in the flow other than steps SP61-64 and steps 71-74 are substantially the same as those shown in FIG. 4. The value Limin of the detected signal at the maximum variation point of the deposited coin is compared with P1max at step SP61, with P1min at step SP71, with P2max at step Sp62, with P2min at step SP72, with P3max at step SP63, with P3min at step SP73, with P4max at step SP64 and with P4min at step SP74, respectively. By the determination at each of these steps, it is determined whether Limin of the deposited coin is in any coin acceptable range or out of all the coin acceptance ranges. If the Limin is determined to be within any one of the coin acceptance ranges, gate actuating signals for distributing gates 10, 101, 102 and 103 are output from solenoid drive circuit 8 according to the result of the determinations in the above steps. The deposited coin is sent to one of coin paths 31, 32, 33 and 34 according to the type of the coin. If the Limin is determined to be out of all the coin acceptance ranges, the deposited coin is judged to be an unacceptable coin or a slug and it is sent to discharge path 12.

The correction of the coin acceptance range at steps SP9, SP10, SP11 and SP12 and the storing of the renewed Pimax and Pimin at step SP13 are operated in substantially the same manner as in FIG. 4.

Although several preferred embodiments of the present invention have been described herein in detail, it will be appreciated by those skilled in the art that various modifications and alterations can be mode to these embodiments without materially departing from the novel teachings and advantages of this invention. Accordingly, it is to be understood that all such modifications and alterations are included within the scope of the invention as defined by the following claims.

What is claimed is:

1. A coin testing apparatus comprising:

a sensor provided on a coin path for outputting a detected signal varying according to a characteristic of a coin deposited into said coin path;

means for determining a value of said detected signal at a maximum variation point of said detected signal when said coin passes through a sensing area of said sensor;

means for discriminating authenticity and type of said coin by comparing said value of said detected signal at said maximum variation point with a coin acceptance range defined by a maximum reference value and a minimum reference value;

means for determining a maximum value and a minimum value among values of a plurality of detected signals at said maximum variation point for a plurality of a type of coins which are deposited into said coin path;

means for initializing said coin acceptance range by setting a value calculated by adding a predetermined value to said maximum value as said maximum reference value and a value calculated by substracting a predetermined value from said minimum value as said minimum reference value; and means for renewing said coin acceptance range, when a plurality of coins deposited into said coin path are discriminated by said discriminating means after said initialization, by subtracting a predetermined value from said maximum reference value and said minimum reference value, respectively, and storing as renewed maximum and minimum reference values, respectively, when said value of said detected signal at said maximum variation point of any of said deposited coins is substantially equal to said minimum reference value, and by adding a predetermined value to said maximum reference value and said minimum reference value, respectively, and storing as renewed maximum and minimum reference values, respectively, when said value of said detected signal at said maximum variation point of any of said deposited coins is substantially equal to said maximum reference value.

2. The apparatus according to claim 1 further comprising a mode selector for switching an operation mode of the apparatus between an adjusting mode for initializing said coin acceptance range and a testing mode for testing said deposited coins.

3. The apparatus according to claim 1, wherein said sensor comprises a pair of coils each disposed on each side of said coin path, one of said pair of coils being connected to an oscillator and said detected signal is produced by an induced voltage signal induced in the other of said coils.

4. The apparatus according to claim 3, wherein said induced voltage signal is converted to a D.C. voltage by a DC converter.

5. The apparatus according to claim 1, wherein said detected signal is an analog signal and the analog signal is converted to a digital signal.

6. The apparatus according to claim 1 further comprising a control unit having a first memory and a second memory, a program for discrimination and calculation being stored in said first memory, said initialized maximum and minimum reference values and said renewed maximum and minimum reference values being stored in said second memory.

7. The apparatus according to claim 1 further comprising distributing means provided on said coin path at a position downstream of said sensor for distributing the deposited coins to an acceptable coin path and a discharge path according to their authenticity as determined by said discriminating means.

8. The apparatus according to claim 1, wherein said coin acceptance range further comprises a plurality of said coin acceptance ranges corresponding to a plurality of types of coins.

9. The apparatus according to claim 8, wherein said plurality of coin acceptable ranges do not overlap.

* * * * *